US010145658B2

(12) United States Patent
Mimura et al.

(10) Patent No.: US 10,145,658 B2
(45) Date of Patent: Dec. 4, 2018

(54) SMOKE SCREEN GENERATOR

(71) Applicant: DAICEL CORPORATION, Osaka-shi, Osaka (JP)

(72) Inventors: Atsushi Mimura, Tatsuno (JP); Yuji Higuchi, Tatsuno (JP); Takao Kuroda, Tatsuno (JP); Katsuhiro Nakahashi, Tatsuno (JP)

(73) Assignee: DAICEL CORPORATION, Osaka-Shi (JP)

( * ) Notice: Subject to any disclaimer, the term of this patent is extended or adjusted under 35 U.S.C. 154(b) by 0 days.

(21) Appl. No.: 15/759,934

(22) PCT Filed: Oct. 4, 2016

(86) PCT No.: PCT/JP2016/079379
§ 371 (c)(1),
(2) Date: Mar. 14, 2018

(87) PCT Pub. No.: WO2017/068957
PCT Pub. Date: Apr. 27, 2017

(65) Prior Publication Data

US 2018/0259301 A1 Sep. 13, 2018

(30) Foreign Application Priority Data

Oct. 20, 2015 (JP) ..... 2015-206626

(51) Int. Cl.
*F42B 12/48* (2006.01)
*F41H 9/08* (2006.01)
*G06D 3/00* (2006.01)

(52) U.S. Cl.
CPC ..... *F41H 9/08* (2013.01); *G06D 3/00* (2013.01)

(58) Field of Classification Search
CPC ... F41H 9/08; F41H 9/06; B60R 2021/26041; B60R 21/2644; C06B 21/0041;
(Continued)

(56) References Cited

U.S. PATENT DOCUMENTS 4,622,899 A * 11/1986 Weber ..... C06D 3/00 102/334
5,094,168 A * 3/1992 Rumer ..... F41H 9/06 102/334
(Continued)

FOREIGN PATENT DOCUMENTS

JP 2003-208672 A 7/2003
JP 3816867 B2 8/2006
(Continued)

OTHER PUBLICATIONS

International Search Report (PCT/ISA/210) issued in PCT/JP2016/079379, dated Dec. 20, 2016.
(Continued)

*Primary Examiner* — Michael D David
(74) *Attorney, Agent, or Firm* — Birch, Stewart, Kolasch & Birch, LLP

(57) ABSTRACT

The present invention provides a smoke screen generator with a high diffusion rate of a smoke screen.
Openings at both ends of a cylindrical housing are closed by a first closure 20 including an igniter and a second closure 30 having a smoke screen source discharge port 38 respectively. A porous cylindrical body 50 is arranged between the first closure 20 and the second closure 30. When an igniter 5 is actuated, a smoke screen generating agent 56 in a smoke screen generating agent-accommodating chamber 55 is ignited and burned, and a smoke screen source is generated. The smoke screen source moves and passes through the porous cylindrical body 50 and, after passing through a
(Continued)

smoke screen source discharge port 38, the smoke screen source is discharged to the outside to generate a smoke screen.

4 Claims, 2 Drawing Sheets

(58) Field of Classification Search
CPC . F42B 3/117; F42B 4/26; F42B 12/48; C06D 3/00
USPC ..... 102/334, 335, 205
See application file for complete search history.

(56) References Cited

U.S. PATENT DOCUMENTS 5,259,318 A * 11/1993 Alker ..... F41H 9/06 102/334
5,313,888 A * 5/1994 Martin ..... C06B 21/0041 102/205
5,454,324 A * 10/1995 Larmignat ..... F42B 5/155 102/334
5,610,359 A * 3/1997 Spector ..... A62C 5/006 102/334
6,047,644 A * 4/2000 Malecki ..... F41H 9/06 102/334
6,412,416 B1 * 7/2002 Rouse ..... F42B 5/15 102/334
2003/0097950 A1 * 5/2003 Raupp ..... F42B 5/15 102/334
2007/0024038 A1 2/2007 Numoto et al.
2009/0321534 A1 * 12/2009 Flanigan ..... A61L 9/03 239/13
2012/0180685 A1 * 7/2012 O ..... F42B 8/14 102/334
2014/0020588 A1 * 1/2014 Erbach ..... C06D 3/00 102/334
2017/0267602 A1 * 9/2017 Banish ..... C06D 3/00

FOREIGN PATENT DOCUMENTS

JP 2007-030656 A 2/2007
JP 3134430 U 8/2007
JP 2015-042603 A 3/2015
JP 2015-043143 A 3/2015

OTHER PUBLICATIONS

Written Opinion (PCT/ISA/237) issued in PCT/JP2016/079379, dated Dec. 20, 2016.
International Preliminary Report on Patentability and English translation of the Written Opinion of the International Searching Authority (forms PCT/IB/373 and PCT/ISA/237), dated Apr. 24, 2018, for International Application No. PCT/JP2016/079379.

* cited by examiner

[Fig. 1]
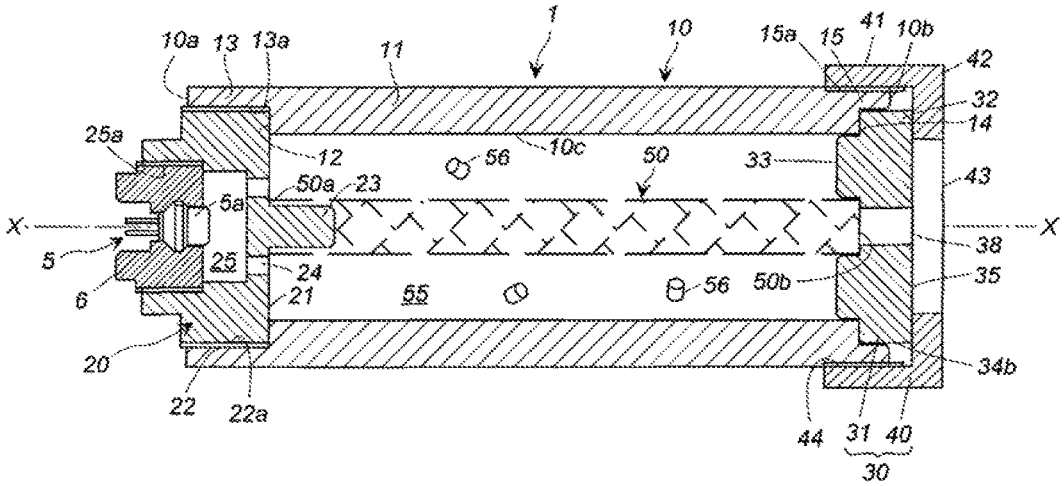
[Fig. 2]
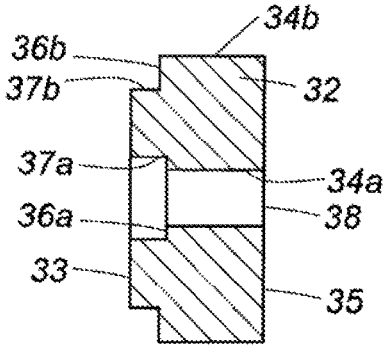

[Fig. 3]
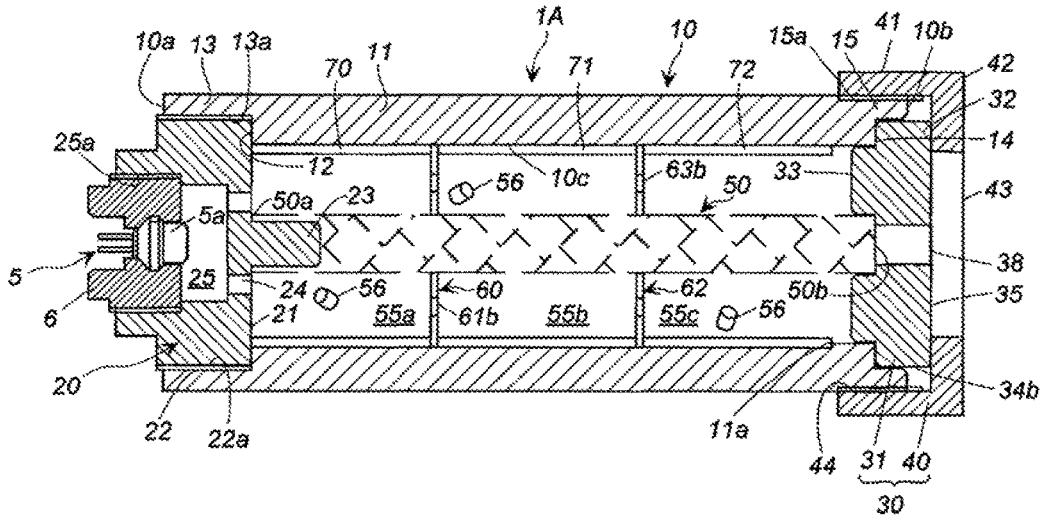
[Fig. 4]
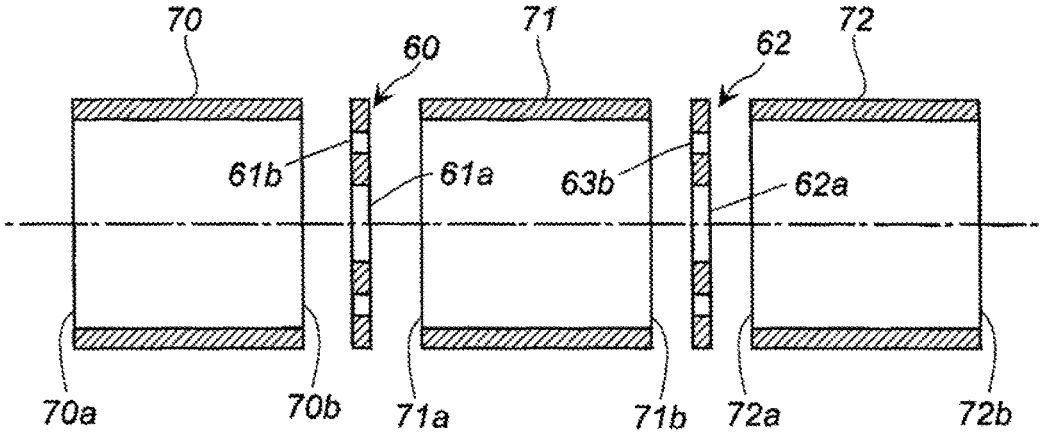

SMOKE SCREEN GENERATOR

TECHNICAL FIELD

The present invention relates to a smoke screen generator which is usable as a security apparatus.

DESCRIPTION OF RELATED ART

A smoke screen generator may be mounted to a ceiling, a wall, or the like of a room in order to mentally confuse an intruder breaking and entering a store, a room, or the like by visually blocking an escape route and to secure time until the intruder is captured.

JP-B No. 3816867 discloses an invention of a smoke screen generation apparatus. As shown in FIGS. 1 to 5, the smoke screen generation apparatus has a disk-like outer shape and, at the time of actuation, discharges a smoke screen in a radial direction.

In the apparatus shown in FIG. 1, when an ignition device 2 is actuated, an ignition agent 5 inside an ignition agent case 4 is ignited and burned, and flames and the like are generated.

Subsequently, the flames and the like flow into a combustion chamber 10 to ignite and burn a smoke generating agent 6, and smoke is generated.

JP-A No. 2015-43143 discloses an invention of a smoke generator. As shown in FIGS. 1 and 3, this is a smoke screen generation apparatus similar to that of JP-B No. 3816867, which has a disk-like outer shape and, at the time of actuation, discharges a smoke screen in a radial direction.

With the smoke generator according to JP-A No. 2015-43143, since a burning rate of an entire smoke generating agent is improved, an ejection rate and a diffusion rate of generated smoke into a room are also elevated. SUMMARY OF INVENTION The present invention provides a smoke screen generator including a cylindrical housing, an igniter and a smoke screen generating agent which are accommodated in the cylindrical housing, a first closure including an igniter and closing a first end opening of the cylindrical housing, a second closure having a smoke screen source discharge port and closing a second end opening of the cylindrical housing on an opposite side in an axial direction to the first end opening, the first closure having a discharge hole for discharging an ignition product which is generated at the time of actuation of the igniter, a porous cylindrical body being arranged between a surface of the first closure where the discharge hole for the ignition product is not provided and the smoke screen source discharge port of the second closure, a space between an inner circumferential wall surface of the cylindrical housing and the porous cylindrical body being a smoke screen generating agent-accommodating chamber which accommodates the smoke screen generating agent, and the discharge hole for the ignition product facing the smoke screen generating agent-accommodating chamber, and at the time of actuation of the igniter, the smoke screen generating agent in the smoke screen generating agent-accommodating chamber being ignited and burned to generate a smoke screen source, the smoke screen source moving through the inside of the porous cylindrical body, passing through the smoke screen source discharge port, and thereafter being discharged to the outside to generate a smoke screen.

BRIEF DESCRIPTION OF DRAWINGS

The present invention will become more fully understood from the detailed description given hereinbelow and the accompanying drawings which are given by way of illustration only, and thus are no limitative of the present invention and wherein:

FIG. 1 shows a cross-sectional view in an axial direction of a smoke screen generator according to the present invention;

FIG. 2 shows a cross-sectional view in an axial direction of a first member of a second closure used in FIG. 1;

FIG. 3 shows a cross-sectional view in an axial direction of a smoke screen generator which is a different embodiment of the present invention; and FIG. 4 shows a cross-sectional view in an axial direction of annular partition plates used in FIG. 3.

DETAILED DESCRIPTION OF INVENTION

In the apparatus shown in FIG. 1 of JP-B No. 3816867, since the smoke generating agent in the combustion chamber 10 burns in sequence from a position near the ignition agent case 4 to a position far from the ignition agent case 4, combustion of the entire smoke generating agent 6 takes time, resulting in a slow ejection rate of generated smoke from the apparatus into a room and also a slow diffusion rate of the generated smoke.

Since the apparatuses according to the inventions of JP-B No. 3816867 and JP-A No. 2015-43143 both have a disk-like outer shape and radially eject and diffuse generated smoke, directionality cannot be imparted to an ejection direction of the generated smoke.

In order to impart directionality to the ejection direction of generated smoke, a smoke generating apparatus with a cylindrical outer shape is conceivably used. However, if such an apparatus with a cylindrical outer shape is used, it is difficult to increase an ignition and combustion rate of an entire smoke generating agent and further elevate an ejection rate and a diffusion rate of generated smoke into a room.

The present invention provides a smoke screen generator in which an ignition and combustion rate of an entire smoke screen generating agent is increased and an ejection rate and a diffusion rate of generated smoke into a room are also elevated even with a use of a cylindrical container.

A cylindrical housing is made of a metal such as iron or stainless steel and has a first end opening and a second end opening.

A first closure has a shape and a size which are capable of closing the first end opening of the cylindrical housing.

The first closure is attached to the first end opening of the cylindrical housing by being screwed thereinto, by being press-fitted thereinto, or by being welded thereto.

An igniter and the first closure may be integrated, or the igniter may be disposed in the first closure.

As the igniter, a known igniter for a gas generator used in an airbag apparatus can be used.

A second closure has a shape and a size which are capable of closing the second end opening of the cylindrical housing.

The second closure is attached to the second end opening of the cylindrical housing by being screwed thereinto, by being press-fitted thereinto, or by being welded thereto.

The second closure may be formed of a single member or may be formed of a combination of two members.

When the second closure is formed of a combination of two members, the two members are integrated by being screwed into each other, by being press-fitted into each other, or by being welded to each other.

A porous cylindrical body needs only to be a metallic cylindrical member having a large number of holes on a circumferential surface thereof, and a net molded into a cylindrical shape, a cylinder with a large number of holes formed on a circumferential surface thereof, and the like can be used. However, it is preferable that the porous cylindrical body is a net molded into a cylindrical shape.

Holes of the porous cylindrical body (a mesh size of the net) preferably are in such a size as prevents entry of a smoke screen generating agent accommodated in a smoke screen generating agent-accommodating chamber.

In addition, when a smoke screen generating agent which is smaller than the holes of the porous cylindrical body (the mesh size of the net) is used as the smoke screen generating agent accommodated in the smoke screen generating agent-accommodating chamber, a combustible member such as paper can be interposed between the porous cylindrical body and the smoke screen generating agent in order to prevent the smoke screen generating agent from entering a discharge path of the smoke screen source.

Prior to actuation, the porous cylindrical body acts to push the smoke screen generating agent accommodated in the smoke screen generating agent-accommodating chamber radially outward and therefore functions to prevent gaps from being created in the smoke screen generating agent-accommodating chamber, and at the time of actuation, the porous cylindrical body functions as a discharge path of a smoke screen source generated by combustion of the smoke screen generating agent.

The smoke screen generating agent is preferably a known smoke screen generating agent molded into a columnar shape or the like, but the smoke screen generating agent may be in a powder form. As the smoke screen generating agent, for example, a smoke generating agent composition including a smoke generating agent and a gas generating agent disclosed in JP-A No. 2015-42603 or a combination of the smoke generating agent and the gas generating agent disclosed in JP-A No. 2015-43143 can be used.

Since the igniter is positioned on the side of the first end opening together with the first closure, when the igniter is actuated, the smoke screen generating agent in the smoke screen generating agent-accommodating chamber is ignited and burned from the side of the first closure and the combustion proceeds toward the second closure.

However, in the smoke screen generator according to the present invention, since the porous cylindrical body is arranged in a central portion of the smoke screen generating agent-accommodating chamber in a range from the first closure to the second closure, when the smoke screen generating agent is ignited and burned from the side of the first closure, high-temperature gas generated by the combustion enters the porous cylindrical body and, while moving in the axial direction, ignites and burns the smoke screen generating agent in contact with the porous cylindrical body.

Therefore, compared to a case where the combustion of the smoke screen generating agent only proceeds from the first closure toward the second closure, overall combustion proceeds more quickly and ejection and diffusion of a smoke screen are also promoted.

It is possible in the smoke screen generator according to the present invention that the smoke screen generating agent-accommodating chamber accommodating the smoke screen generating agent is divided into a plurality of chambers in an axial direction by an annular partition plate arranged in a radial direction and the annular partition plate has a through hole in a thickness direction.

The annular partition plate is made of metal, an inner diameter thereof has a size such that the annular partition plate abuts against an outer circumferential surface of the porous cylindrical body, and an outer diameter thereof has a size such that the annular partition plate abuts against an inner circumferential surface of the cylindrical housing.

The annular partition plate has a through hole in a thickness direction, and the through hole is preferably formed in a large number at equal intervals in an annular surface of the annular partition plate.

In order to easily arrange the annular partition plate in the cylindrical housing and to easily accommodate the smoke screen generating agent, one or a combination of two or more annular walls whose interior is partitioned by the annular partition plate can be used.

One or two or more annular partition plates can be used.

When a single annular partition plate is used, the smoke screen generating agent-accommodating chamber is divided into two in the axial direction, and when two annular partition plates are used, the smoke screen generating agent-accommodating chamber is divided into three in the axial direction.

The annular partition plate is preferably used to divide the smoke screen generating agent-accommodating chamber in the axial direction in this manner because a combustion rate of the smoke screen generating agent is controlled and a higher smoke screen effect is obtained thereby.

A case will be described in which the smoke screen generating agent-accommodating chamber is divided by a first annular partition plate and a second annular partition plate into a first chamber, a second chamber and a third chamber in the axial direction in this order from the side of the first end opening.

As described earlier, in the smoke screen generating agent-accommodating chamber (the first to third chambers), at the time of actuation, combustion proceeds radially outward from the inside due to an action of the porous cylindrical body.

At this point, combustion gas generated in the first chamber where combustion starts first also enters the second chamber from the through hole provided in the first annular partition plate between the first chamber and the second chamber. Therefore, the combustion of the smoke screen generating agent in the second chamber proceeds radially outward from the inside and, at the same time, the combustion thereof also proceeds in the axial direction from the first annular partition plate, whereby the combustion of the smoke screen generating agent is controlled.

Subsequently, in the third chamber, since the combustion similarly proceeds radially outward from the inside and, at the same time, the combustion also proceeds in the axial direction from the second annular partition plate, the combustion of the smoke screen generating agent is controlled.

It is preferable in the smoke screen generator according to the present invention that the first closure has a protrusion on a surface in a central portion of the first closure where the discharge hole for an ignition product is not provided, the second closure is provided with an annular stepped surface which is formed in an opening of the smoke screen source discharge port of the second closure at a position facing the protrusion of the first closure in the axial direction, and an opening of the porous cylindrical body at one end is fitted to an outer side of the protrusion of the first closure and an opening at the other end is abutted against the annular stepped surface to fix the porous cylindrical body.

In this manner, by fitting and fixing the porous cylindrical body between the protrusion of the first closure and the annular stepped surface (a depressed portion) of the second closure, the porous cylindrical body is easily attached.

Since the smoke screen generator according to the present invention provides a high ignition and combustion rate of a smoke screen generating agent and also a high diffusion rate of a smoke screen, the smoke screen generator according to the present invention is suitable as a security apparatus.

The smoke screen generator according to the present invention is usable as a security apparatus.

Embodiments of Invention

<Smoke Screen Generator Shown in FIG. 1>

In a smoke screen generator 1, a smoke screen generating agent 56 and various parts are arranged inside a cylindrical housing 10.

A first annular stepped surface 12 is provided on an inner circumferential surface of a circumferential wall 11 on the side of a first end 10*a* of the cylindrical housing 10, and a section between the first annular stepped surface 12 and the first end 10*a* corresponds to a first tip circumferential wall 13 which is reduced in thickness. An inner circumferential surface 13*a* of the first tip circumferential wall 13 has a screw portion.

A second annular stepped surface 14 is provided on the inner circumferential surface of the circumferential wall 11 on the side of a second end 10*b* of the cylindrical housing 10, and a section between the second annular stepped surface 14 and the second end 10*b* corresponds to a second tip circumferential wall 15 which is reduced in thickness. An outer circumferential surface 15*a* of the second tip circumferential wall 15 has a screw portion.

The first end 10*a* of the cylindrical housing 10 is closed by a first closure 20.

The first closure 20 is substantially in a cup shape and has a bottom surface 21 and a circumferential wall 22.

The bottom surface 21 has a protrusion 23 in a central portion thereof and has, around the protrusion 23, a plurality of discharge holes 24 for an ignition product formed by piercing the bottom surface 21. Around two to eight of the discharge holes 24 for the ignition product are formed at equal intervals in a circumferential direction.

Further, when necessary, a seal tape may be provided on the discharge holes 24 in the bottom surface 21 in order to prevent spillage of a smoke screen generating agent or as a measure against humidity.

The circumferential wall 22 has a screw portion 22*a* which is screwed into the screw portion of the inner circumferential surface 13*a* of the first tip circumferential wall 13.

An igniter 5 including an igniter collar 6 is disposed in an internal space 25 of the first closure 20.

The igniter 5 is mounted by screwing the igniter collar 6 into an inner circumferential wall surface 25*a* of the first closure 20.

An ignition portion 5*a* of the igniter 5 is positioned inside the internal space 25.

The second end 10*b* of the cylindrical housing 10 is closed by a second closure 30.

The second closure 30 is formed of a combination of a first member 31 and a second member 40, but the second closure 30 may be formed of a single member.

As shown in FIGS. 1 and 2, the first member 31 has an annular substrate 32 with a larger outer diameter, an annular protrusion 33, which is formed on the annular substrate 32 and has an outer diameter smaller than that of the annular substrate 32, an inner circumferential wall 34*a* of the annular substrate, an outer circumferential wall 34*b* of the annular substrate, and an annular bottom surface 35.

Due to a difference in outer diameters between the annular protrusion 33 and the annular substrate 32, the annular protrusion 33 has an annular inner stepped surface 36*a* which is arranged on the side of the inner circumferential wall 34*a* of the annular substrate and faces in the direction of the axis X, and an annular outer stepped surface 36*b* which is arranged on the side of the outer circumferential wall 34*b* of the annular substrate and faces in the direction of the axis X.

Due to a difference in outer diameters between the annular protrusion 33 and the annular substrate 32, the annular protrusion 33 has an annular inner circumferential wall surface 37*a*which faces inward in a radial direction (a direction orthogonal to the direction of the axis X), and an annular outer circumferential wall surface 37*b* which faces outward in the radial direction.

A smoke screen source discharge port 38 is formed in a central portion of the first member 31 inside the annular inner stepped surface 36*a*.

The first member 31 is fitted into an opening of a second end 10*b* of the cylindrical housing 10 in a state where the annular outer circumferential wall surface 37*b* abuts against the inner circumferential wall surface 10*c* of the cylindrical housing 10, the annular outer stepped surface 36*b* abuts against the second annular stepped surface 14, and the outer circumferential wall 34*b* of the annular substrate abuts against the second tip circumferential wall 15.

The second member 40 is substantially in a cup-shape and has a circumferential wall 41 and a bottom surface 42 which is provided with a through hole 43 in a central portion thereof. The circumferential wall 41 has a screw portion 44 on an inner circumferential surface thereof.

An inner diameter of the through hole 43 is larger than an inner diameter of the smoke screen source discharge port 38 but smaller than an outer diameter of the annular bottom surface 35.

The second member 40 is fixed by the screw portion 44 screwed onto the outer circumferential surface 15*a* of the second tip circumferential wall 15.

Since the bottom surface 42 of the second member 40 presses the annular bottom surface 35 of the first member 31 in the direction of the axis X (a direction toward the first end 10*a*), the first member 31 is held between the second member 40 and the second annular stepped surface 14 and fixed thereby.

A porous cylindrical body 50 which is formed of a net molded in a cylindrical shape is disposed inside the cylindrical housing 10.

In the porous cylindrical body 50, a first opening 50*a* is fitted onto the protrusion 23 of the first closure 20 from the outer side, and a second opening 50*b* is abutted against the annular inner stepped surface 36*a* and the annular inner circumferential wall surface 37*a* of the first member 31 of the second closure.

Since the porous cylindrical body 50 is fixed from both sides in the direction of the axis X, the porous cylindrical body 50 does not move prior to actuation and at the time of actuation.

A cylindrical space between the inner circumferential wall surface 10*c* of the cylindrical housing 10 and the porous cylindrical body 50 is a smoke screen generating agent-accommodating chamber 55 which accommodates a smoke screen generating agent 56.

The smoke screen generating agent 56 is a known smoke screen generating agent, and a smoke generating agent composition including a smoke generating agent and a gas generating agent disclosed in JP-A No. 2015-42603 or a combination of a smoke generating agent and a gas generating agent disclosed in JP-A No. 2015-43143, or the like can be used.

The smoke screen generating agent 56 can be provided in an agent form with a desired shape such as a columnar shape, a disk shape, a powder shape, and a granular shape.

The smoke screen generating agent-accommodating chamber 55 faces, on the side of the first end 10*a*, the plurality of the discharge holes 24 for the ignition product which are formed on the bottom surface 21 of the first closure 20, and, on the side of the second end 10*b*, the first member 31 of the second closure 30.

The igniter 5, the porous cylindrical body 50, the smoke screen source discharge port 38 and the through hole 43 of the second member 40 are arranged such that central axes thereof and the axis X of the cylindrical housing 10 are coaxial with each other.

An embodiment of a method for assembling the smoke screen generator 1 shown in FIG. 1 will be described, but the assembling method is not limited thereto.

In a state where the first member 31 is arranged at the opening of the second end 10*b* of the cylindrical housing 10, the second member 40 is screwed to the cylindrical housing 10 from the outside to be fixed, and thereby, the opening of the second end 10*b* is closed.

Next, in a state where the second opening 50*b* of the porous cylindrical body 50 is fitted into the annular inner stepped surface 36*a* of the first member 31, a prescribed amount of the smoke screen generating agent 56 is charged into the smoke screen generating agent-accommodating chamber 55.

Subsequently, while the first closure 20 is screwed into the tip circumferential wall 13 of the cylindrical housing 10, the protrusion 23 is fitted into the first opening 50*a* of the porous cylindrical body 50.

Next, the igniter 5 is screwed into the first closure 20 to be fixed.

Next, an operation of the smoke screen generator 1 will be described with reference to FIG. 1.

When the igniter 5 is actuated and an ignition product such as flames is discharged into the internal space 25, the ignition product is discharged into the smoke screen generating agent-accommodating chamber 55 from the discharge holes 24 for the ignition product and the smoke screen generating agent 56 is ignited and burned.

A high-temperature smoke screen source generated by the combustion of the smoke screen generating agent 56 passes through the porous cylindrical body 50 and moves in a direction toward the second closure 30 from the first closure 20.

The combustion of the smoke screen generating agent 56 proceeds in the direction toward the second closure 30 from the first closure 20. At the same time, since ignition and combustion also proceed as the high-temperature smoke screen source, which is passing through the porous cylindrical body 50, comes into contact with the smoke screen generating agent 56, the combustion also proceeds outward from the inside in a radial direction.

Since the combustion of the smoke screen generating agent 56 proceeds in different directions in this manner, even when the cylindrical housing 10 (the smoke screen generating agent-accommodating chamber 55) in an elongated shape as shown in FIG. 1 is used, a rate in which the combustion of the smoke screen generating agent 56 proceeds increases.

After moving through the porous cylindrical body 50, the smoke screen source passes through the smoke screen source discharge port 38 of the first member 31, and is then cooled when discharged into a room from the through hole 43 of the second member 40 to create a smoke screen.

<Smoke Screen Generator Shown in FIG. 3>

A smoke screen generator 1A shown in FIG. 3 is the same as the smoke screen generator 1 shown in FIG. 1 with the exception of using a first inner cylindrical member 70, a second inner cylindrical member 71, a third inner cylindrical member 72, and two annular partition plates including a first annular partition plate 60 and a second annular partition plate 62 shown in FIG. 4.

The first annular partition plate 60 is arranged in a state of being held between a second opening 70*b* of the first inner cylindrical member 70 and a first opening 71*a* of the second inner cylindrical member 71. The first annular partition plate 60 has a through hole 61*a* through which the porous cylindrical body 50 passes and a first smoke screen source passage hole 61*b* through which the smoke screen source passes at the time of actuation.

The second annular partition plate 62 is arranged in a state of being held between a second opening 71*b* of the second inner cylindrical member 71 and a first opening 72*a* of the third inner cylindrical member 72. The second annular partition plate 62 has a through hole 62*a* through which the porous cylindrical body 50 passes and a second smoke screen source passage hole 62*b* through which the smoke screen source passes at the time of actuation.

Sizes of the first smoke screen source passage hole 61*b* and the second smoke screen source passage hole 62*b* may be smaller or larger than the smoke screen generating agent 56.

While the number of the first smoke screen source passage hole 61*b* and the number of the second smoke screen source passage hole 62*b* are not particularly limited, around 4 to 20 holes can be dispersedly formed at equal intervals on the first annular partition plate 60 and the second annular partition plate 62 respectively.

The smoke screen generating agent-accommodating chamber 55 is divided by the first annular partition plate 60 and the second annular partition plate 62 into a first chamber 55*a*, a second chamber 55*b*, and a third chamber 55*c* in this order from the first closure 20 to the second closure 30.

An outer diameter of the first inner cylindrical member 70, the second inner cylindrical member 71 and the third inner cylindrical member 72 is adjusted to a size such that the inner cylindrical members are inserted into the cylindrical housing 10 and abutted against the inner circumferential wall surface 10*c*.

In FIG. 3, by adjusting a thickness of the circumferential wall 11 of the cylindrical housing 10, the second opening 72*b* of the third inner cylindrical member 72 abuts against an annular stepped surface 11*a* on the side of the second closure 30, and the first opening 70*a* of the first inner cylindrical member 70 abuts against the first closure 20, and thereby, the first, second and third inner cylindrical members are fixed in the direction of the axis X.

An embodiment of a method for assembling the smoke screen generator 1A shown in FIG. 3 will be described, but the method is not limited thereto.

In a state where the first member 31 is arranged at the opening of the second end 10*b* of the cylindrical housing 10, the second member 40 is screwed to the cylindrical housing 10 from the outside to be fixed, and thereby the opening of the second end 10*b* is closed.

Next, the second opening 50*b* of the porous cylindrical body 50 is fitted into the annular inner stepped surface 36*a* of the first member 31 to be disposed.

Subsequently, after inserting and arranging the third cylindrical member 72, a prescribed amount (approximately ⅓ of a total amount) of the smoke screen generating agent 56 is charged in the third chamber 55*c*, and the second annular partition plate 62 is then inserted.

Next, a prescribed amount (approximately ⅓ of a total amount) of the smoke screen generating agent 56 is charged in the second chamber 55*b*, and the first annular partition plate 60 is then inserted.

Subsequently, a prescribed amount (approximately ⅓ of a total amount) of the smoke screen generating agent 56 is charged in the first chamber 55*a*.

Next, while screwing the first closure 20 into the tip circumferential wall 13 of the cylindrical housing 10, the protrusion 23 is fitted into the first opening 50*a* of the porous cylindrical body 50.

The igniter 5 is then screwed into the first closure 20 to be fixed.

Next, an operation of the smoke screen generator 1A will be described with reference to FIG. 3.

When the igniter 5 is actuated and an ignition product such as flames is discharged into the internal space 25, the ignition product is discharged into the smoke screen generating agent-accommodating chamber 55 (the first chamber 55*a*) from the discharge holes 24 for the ignition product and the smoke screen generating agent 56 is ignited and burned.

A high-temperature smoke screen source generated by the combustion of the smoke screen generating agent 56 in the first chamber 55*a* proceeds to the first annular partition plate 60, passes through the first smoke screen source passage hole 61*b* of the first annular partition plate 60, enters the second chamber 55*b*, and ignites and burns the smoke screen generating agent 56.

Concurrently therewith, the high-temperature smoke screen source generated inside the first chamber 55*a* passes through the porous cylindrical body 50 and moves from the first chamber 55*a* to the second chamber 55*b*. During this process, the high-temperature smoke screen source comes into contact with the smoke screen generating agent 56 in the second chamber 55*b*, and ignites and burns the same.

A high-temperature smoke screen source generated by the combustion of the smoke screen generating agent 56 in the second chamber 55*b* proceeds to the second annular partition plate 62, passes through the second smoke screen source passage hole 62*b* of the second annular partition plate 62, enters the third chamber 55*c* and ignites and burns the smoke screen generating agent 56.

Concurrently therewith, the high-temperature smoke screen source generated inside the second chamber 55*b* passes through the porous cylindrical body 50 and moves from the second chamber 55*b* to the third chamber 55*c*. During this process, the high-temperature smoke screen source comes into contact with the smoke screen generating agent 56 in the third chamber 55*c*, and ignites and burns the same.

A high-temperature smoke screen source generated by the combustion of the smoke screen generating agent 56 in the third chamber 55*c* moves inside the porous cylindrical body 50 together with the high-temperature smoke screen sources generated in the first chamber 55*a* and the second chamber 55*b*.

In this manner, since the combustion of the smoke screen generating agent 56 proceeds in different directions, i.e. in the direction of the axis X and in a radially outward direction from the inside, even when the cylindrical housing 10 (the smoke screen generating agent-accommodating chamber 55) in an elongated shape as shown in FIG. 3 is used, a rate in which the combustion of the smoke screen generating agent 56 proceeds increases.

After moving through the porous cylindrical body 50, the smoke screen source passes through the smoke screen source discharge port 38 of the first member 31, and is then cooled when discharged into a room from the through hole 43 of the second member 40 to create a smoke screen.

EXAMPLES

<Light Transmittance Measuring Instrument>

(Light Projecting Side Device)

Device name: Visible-light lasers of 405 nm, 635 nm, and 785 nm (Kikoh Giken Co., Ltd)

Model number (635 nm): MLXA-D12-635-5 (CN4)

Model number (785 nm): MLXA-D12-785-70 (CN4)

(Light receiving side device)

Device name: Optical sensor (Hioki E.E. Corporation)

Model number: 9742-10 (amplifier)

Device name: Optical power meter (Hioki E.E. Corporation)

Model number: 3664

(Measuring Instrument)

Device name: Data collection system (Keyence Corporation)

Model number: NR-2000

(Acoustic Measuring Instrument)

Device name: Integrating sound level meter (Ono Sokki Co., Ltd)

Model number: LA-1440

Example 1, Comparative Example 1

For Example 1, a smoke screen generating agent (composition 1 below) was charged into the smoke screen generator shown in FIG. 1.

In addition, Comparative Example 1 was prepared by removing the igniter from the smoke screen generator shown in FIG. 1 and placing a lid on the smoke screen generator, arranging a nichrome wire on the side of a nozzle (the first end opening) to create an ignitable state, removing the inner mesh (the porous cylindrical body) from the inside of the container, and completely filling the container with the smoke screen generating agent (composition 1 below) without creating gaps.

Composition 1 of smoke screen generating agent: sucrose/potassium nitrate/paraffin wax=33/52/15 (mass %)

(Diffusion Rate of Smoke Screen)

The smoke screen generator was placed at center of a floor surface of a laboratory measuring 30 $m^3$ (length 6 m, width 2.5 m, and height 2 m).

The light receiving side device of the light transmittance measuring instrument was set along a long side wall surface of a corner between the long side and a short side, and the light projecting side device was set at a position 50 cm away from the light receiving side device in a long side direction.

Light of 635 nm was irradiated from the light projecting side device and detected by the light receiving side optical sensor, and light transmittance was measured by connecting the optical sensor to the measuring instrument via the amplifier. Time required by the light transmittance to reach 50% was measured and adopted as a diffusion rate of a smoke screen.

(Operating Sound Pressure)

The smoke screen generator was placed at center of a floor surface of a container measuring 30 $m^3$ (length 6 m, width 2.5 m, and height 2 m), and sound pressure at a position 1 m away from the smoke screen generator was measured by a sound pressure meter.

The diffusion rate of a smoke screen was 7 seconds in Example 1 and 225 seconds in Comparative Example. In Example 1, the time until smoke diffused was sufficiently shorter and a smoke screen effect was created more quickly.

The operating sound pressure was 133 dB in Example 1 and 101 dB in Comparative Example 1. In Example 1, operating sound increased to a volume at which an intimidation effect can be exhibited to an intruder as compared to Comparative Example 1.

Examples 2 and 3

For Example 2, a smoke screen generating agent (composition 2 below) was charged into the smoke screen generator shown in FIG. 1. For Example 3, a smoke screen generating agent (composition 2 below) was charged into the smoke screen generator shown in FIG. 3.

Composition 2 of smoke screen generating agent: sucrose/potassium nitrate=39/61 (mass %)

Diffusion rates of a smoke screen were tested in a similar manner to Example 1. However, light of 785 nm was irradiated from the light projecting side device. In addition, light transmittance at 15 minutes after ignition of the igniter was measured. Lower light transmittance indicates a thicker smoke screen.

As a result, the light transmittance of Example 2 was 55% and the light transmittance of Example 3 was 29%. The smoke screen generator of Example 2 (the smoke screen generator shown in FIG. 1) is sufficiently practicable, but Example 3 (the smoke screen generator shown in FIG. 3) had a higher smoke screen effect.

In addition, together with the result of Example 1, it was confirmed that a high smoke screen effect is exhibited even at different wavelengths.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A smoke screen generator comprising a cylindrical housing, an igniter and a smoke screen generating agent which are accommodated in the cylindrical housing, a first closure including an igniter and closing a first end opening of the cylindrical housing, a second closure having a smoke screen source discharge port and closing a second end opening of the cylindrical housing on an opposite side in an axial direction to the first end opening, the first closure having a discharge hole for discharging an ignition product which is generated at the time of actuation of the igniter, a porous cylindrical body being arranged between a surface of the first closure where the discharge hole for the ignition product is not provided and the smoke screen source discharge port of the second closure, a space between an inner circumferential wall surface of the cylindrical housing and the porous cylindrical body being a smoke screen generating agent-accommodating chamber which accommodates the smoke screen generating agent, and the discharge hole for the ignition product facing the smoke screen generating agent-accommodating chamber, and at the time of actuation of the igniter, the smoke screen generating agent in the smoke screen generating agent-accommodating chamber being ignited and burned to generate a smoke screen source, the smoke screen source moving through the inside of the porous cylindrical body, passing through the smoke screen source discharge port, and thereafter being discharged to the outside to generate a smoke screen.

2. The smoke screen generator according to claim 1, wherein the smoke screen generating agent-accommodating chamber accommodating the smoke screen generating agent is divided into a plurality of chambers in an axial direction by an annular partition plate arranged in a radial direction and the annular partition plate has a through hole in a thickness direction.

3. The smoke screen generator according to claim 1, wherein the porous cylindrical body is a net molded into a cylindrical shape.

4. The smoke screen generator according to claim 1, wherein the first closure has a protrusion on a surface in a central portion of the first closure where the discharge hole for an ignition product is not provided, the second closure is provided with an annular stepped surface which is formed in an opening of the smoke screen source discharge port of the second closure at a position facing the protrusion of the first closure in the axial direction, and an opening of the porous cylindrical body at one end is fitted to an outer side of the protrusion of the first closure and an opening at the other end is abutted against the annular stepped surface to fix the porous cylindrical body.

* * * * *